US008858265B2

(12) United States Patent
Chu et al.

(10) Patent No.: US 8,858,265 B2
(45) Date of Patent: Oct. 14, 2014

(54) CONNECTOR WITH LOW NEAR END CROSSTALK

(71) Applicant: Advanced-Connectek Inc., New Taipei (TW)

(72) Inventors: Ping-Chuan Chu, New Taipei (TW); Shun-Hua Zhang, New Taipei (TW); Zhong-Wu Zhu, New Taipei (TW); Xiang-Wei Zhang, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 93 days.

(21) Appl. No.: 13/671,965

(22) Filed: Nov. 8, 2012

(65) Prior Publication Data

US 2014/0004754 A1 Jan. 2, 2014

(30) Foreign Application Priority Data

Jun. 27, 2012 (CN) ..... 2012 2 0303832 U

(51) Int. Cl.
*H01R 24/00* (2011.01)

(52) U.S. Cl.
USPC ..... 439/676

(58) Field of Classification Search
USPC ..... 439/676, 76.1, 607.01, 541.5, 626, 92, 439/108, 101
See application file for complete search history.

(56) References Cited

U.S. PATENT DOCUMENTS

| | | | | |
|---|---|---|---|---|
| 7,547,217 | B1 * | 6/2009 | Lin | 439/76.1 |
| 8,172,585 | B2 | 5/2012 | Chiu et al. | |
| 2006/0042816 | A1 * | 3/2006 | Sakurai et al. | 174/88 R |
| 2007/0238330 | A1 * | 10/2007 | Xiao et al. | 439/101 |
| 2009/0163083 | A1 * | 6/2009 | Sawatari et al. | 439/676 |
| 2009/0186533 | A1 * | 7/2009 | Tokunaga | 439/676 |
| 2009/0269978 | A1 * | 10/2009 | Pepe et al. | 439/541.5 |
| 2009/0318024 | A1 * | 12/2009 | Wu | 439/607.01 |
| 2011/0124238 | A1 * | 5/2011 | Zhou et al. | 439/676 |
| 2013/0102199 | A1 * | 4/2013 | Venaleck et al. | 439/626 |
| 2013/0178105 | A1 * | 7/2013 | Hsueh | 439/626 |
| 2013/0178106 | A1 * | 7/2013 | Hsueh | 439/626 |

* cited by examiner

*Primary Examiner* — Jean F Duverne
(74) *Attorney, Agent, or Firm* — Rabin & Berdo, P.C.

(57) ABSTRACT

A connector has a fixture with multiple slits defined therein, multiple terminals, a metal housing and a metal casing. One ends of the terminals are received in corresponding slits and the other ends of the terminals are exposed from the fixture. The metal housing encloses the exposed other ends of the terminals and connected to the metallic baffle. The metal casing encloses the fixture and a part of the metal housing.

6 Claims, 7 Drawing Sheets

CONNECTOR WITH LOW NEAR END CROSSTALK

CROSS-REFERENCE TO RELATED APPLICATION

This application claims priority from application No. 201220303832.7, filed on Jun. 27, 2012 in the State Intellectual Property Office of The People's Republic of China.

FIELD OF THE INVENTION

The invention relates to a connector and, more particularly, to a connector having a ground terminal provided with a metal baffle to separate groups of terminals and a hook integrally formed on the metal baffle to engage with the metal housing.

BACKGROUND OF THE INVENTION

USB (Universal Serial Bus) is a standard serial bus for connecting a computer to a foreign device and also an input/output interface protocol, which is widely used in information products such as personal computers, mobile communication devices and can also be expanded to cameras, digital TVs, video game machines . . . etc.

Following the demands for transmission speed and storing capacity, the transmission speed for USB is up grated from the initial USB 1.0 (Max transmission speed is 12 Mbps), enhanced to USB 2.0 (High Speed)(Max transmission speed is 480 Mbps, and finally to the fastest speed (Super Speed) (Max transmission speed is 5 Gbps) in desire to satisfy consumers' requirements for fast transmission speed and short transmission time especially when a large file is being sent.

Because the USB 3.0 has extremely high transmission speed, problems that never took place before happened. Due to the super high transmission speed, 5 Gbps, each bit shares only 200 picosecond (ps). In contrast, the USB 2.0 has a transmission speed of 480 Mbps and each bit of the USB 2.0 shares 2083 ps when being transmitted. In order to protect the intact of the information being transmitted, there should never be a big gap in transmission time for each bit. However, in high speed digital circuitry, one of the reasons that will affect information accuracy is the near end crosstalk. Near end crosstalk is the electromagnetic coupling interference between two adjacent wires and delays the information reception to each wire, especially when the transmission directions of these two adjacent wires are the same.

With reference to FIGS. 1 and 2, the conventional connector includes multiple terminals 70, a metal housing 71 and a metal casing 72. The terminals 70 is composed of first top signal terminals 700, first bottom signal terminals 701, second top signal terminals 702, second bottom signal terminals 703 and a ground terminal 704. One end of the ground terminal 704 is provided with a metallic baffle 7040. One side of the metallic baffle 7040 corresponds to the first top signal terminals 700 and the first bottom signal terminals 701. The other side of the metallic baffle 7040 corresponds to the second top signal terminals 702 and the second bottom signal terminals 703. The metal housing 71 encloses the terminals 70 and is not connected to the ground terminal 704. The metal casing 72 encloses partially the metal housing 71.

In order to avoid the aforementioned crosstalk, the conventional connector uses the ground terminal 704 to separate the mutually affected first top signal terminals 700 and first bottom signal terminals 701 as well as the second top signal terminals 702 and the second bottom signal terminals 703 so as to direct the near end crosstalk to the ground terminal 704 to reduce interferences caused by the crosstalk. The standard for crosstalk is about 1.2% and the method discussed above reaches only about 0.7% to 1%, which still causes serious crosstalk interference, delays signal transmission and ultimately reduces information accuracy for the USB 3.0.

As the reason set forth, it is crucial to develop a connector to prevent the serious crosstalk interference when the information is being transmitted.

SUMMARY OF THE INVENTION

The primary objective of the present invention is to provide a connector with reduced near end crosstalk.

In order to accomplish the aforementioned objective, the connector constructed in accordance with the present invention has:

a fixture with multiple slits defined therein;

multiple terminals one ends of which are received in corresponding slits and the other ends of which are exposed from the slits, the terminals being composed of first top signal terminals, first bottom signal terminals, second top signal terminals and second bottom signal terminals and a ground terminal, wherein one end of the ground terminal is provided with a metallic baffle whose one side corresponds to the first top signal terminals and the first bottom signal terminals and the other side corresponds to the second top signal terminals and the second bottom signal terminals;

a metal housing enclosing the exposed other ends of the terminals and connected to the metallic baffle; and a metal casing enclosing the fixture and a part of the metal housing.

DETAILED DESCRIPTION OF THE INVENTION

Figure 1:
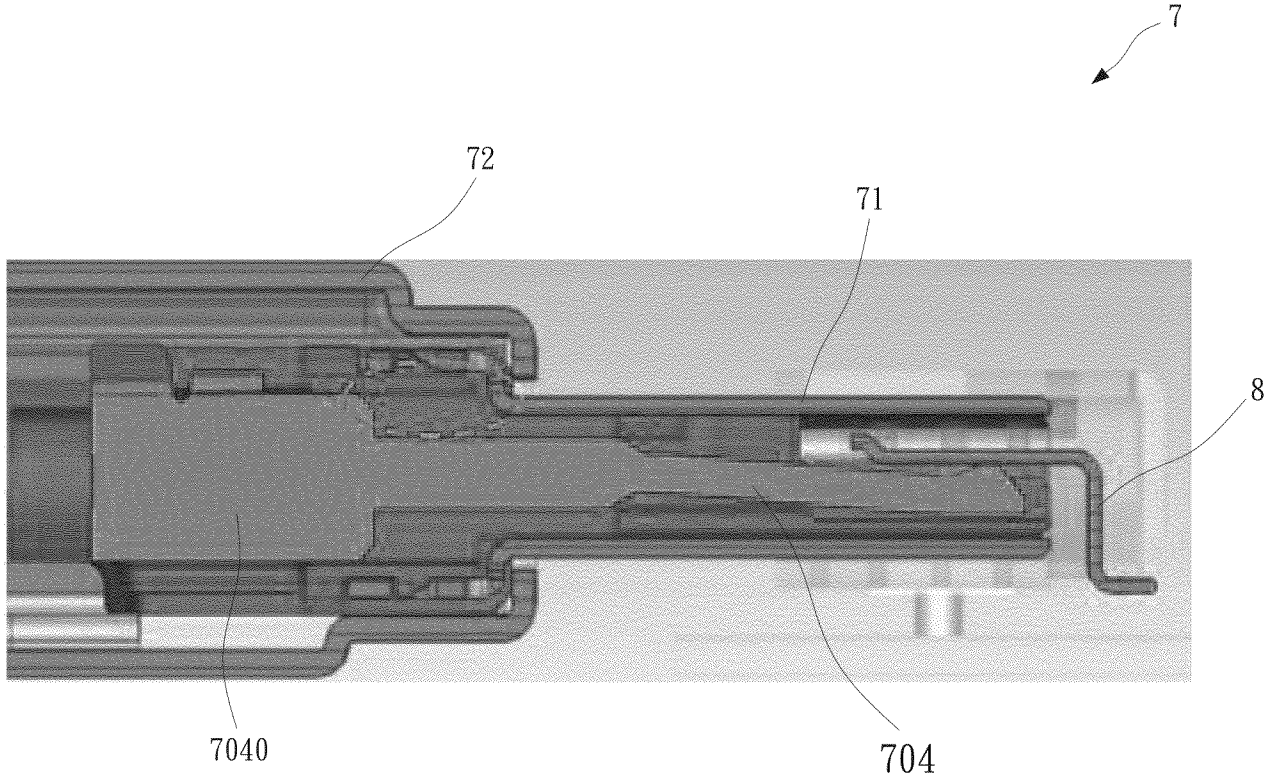
Fig. 1 (prior art)
FIG. 1 is a cross sectional view showing the internal structure of a conventional connector.
Figure 2:
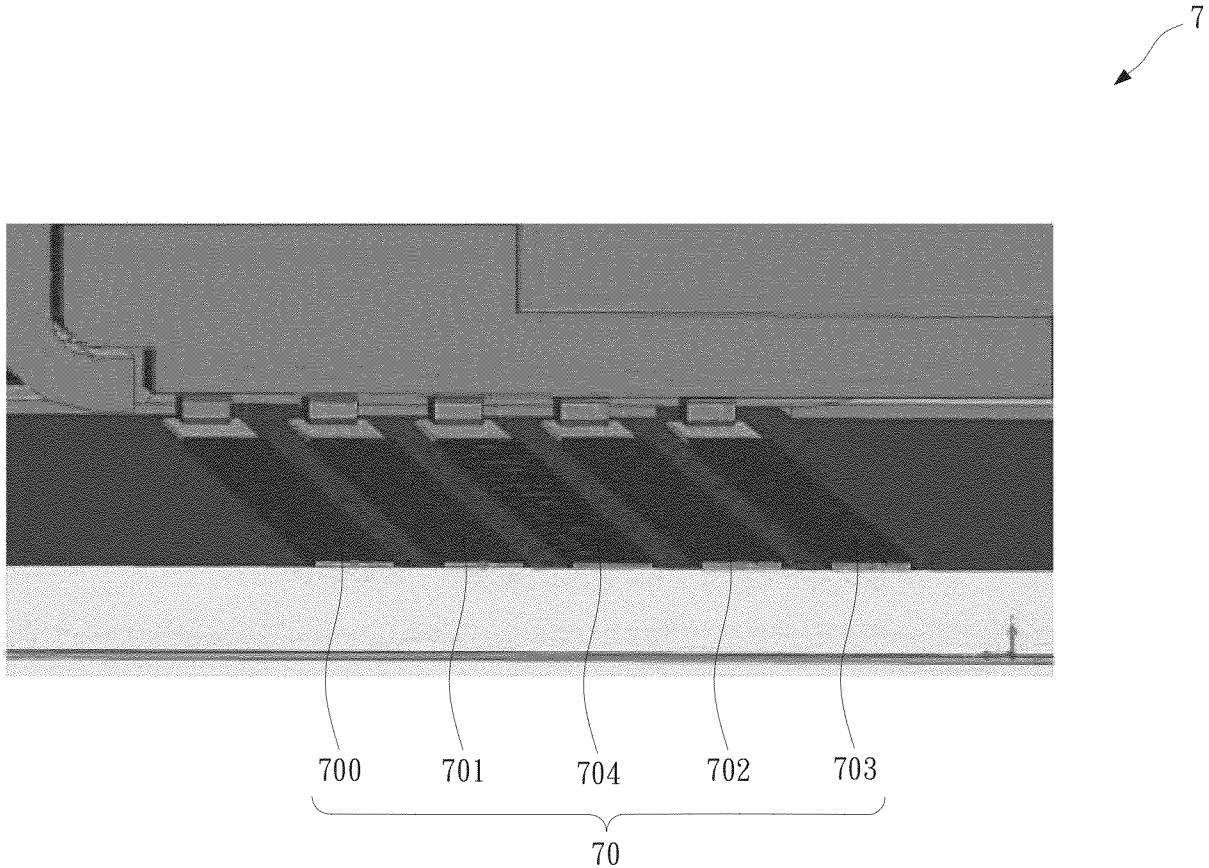
Fig. 2 (prior art)
FIG. 2 is an enlarged cross sectional view showing the arrangement of the terminals used in the conventional connector as shown in FIG. 1.

With reference to FIGS. 3 to 7B, the connector constructed in accordance with the preferred embodiment of the present invention is composed of a fixture 10 with multiple slits 100 defined therein, terminals 11, a metal housing 12 and a metal casing 13.

One ends of the multiple terminals 11 are received in corresponding slits 100 and the other ends thereof are exposed from the fixture 10. The terminals 11 are composed of first top signal terminals 110, first bottom signal terminals 111, second top signal terminals 112, second bottom signal terminals 113 and a ground terminal 114. One end of the ground terminal 114 is provided with a metallic baffle 1140 with one side of which corresponds to the first top signal terminals 110 and the first bottom signal terminals 111 and the other side of which corresponds to the second top signal terminals 112 and the second bottom signal terminals 113.

The metal housing 12 encloses the exposed other ends of the terminals 11 and is connected to the metallic baffle 1140. The metallic casing 13 encloses the fixture 10 and a part of the metal housing 12.

Figure 7A:
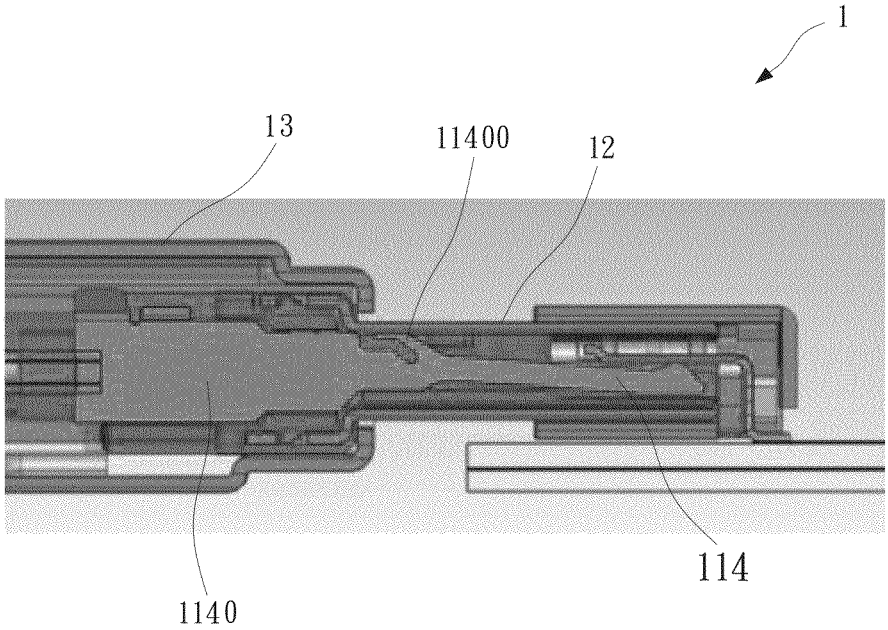
FIG. 7A is a schematic cross sectional view showing the internal structure of the connector of the present invention.
Figure 7B:
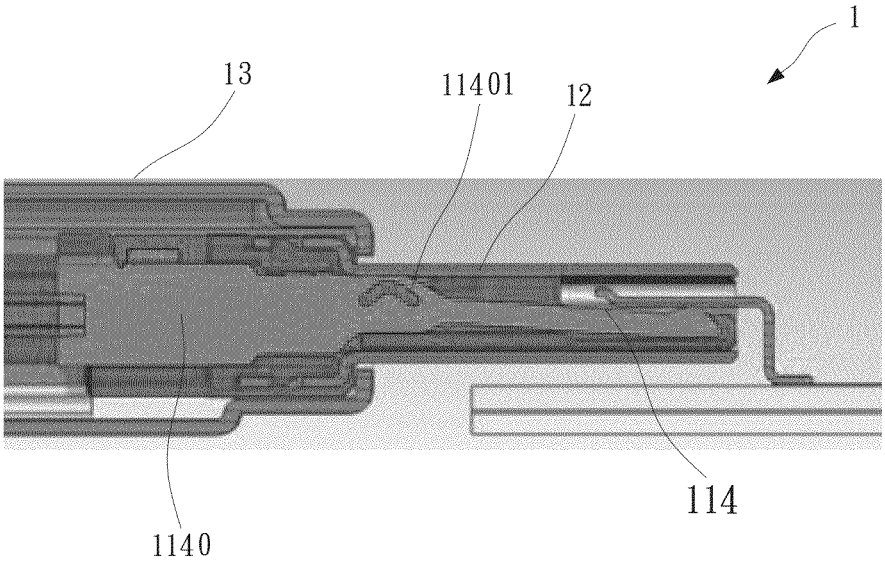
FIG. 7B is still another schematic cross sectional view showing the internal structure of the connector of the present invention.

With reference to FIGS. 7A and 7B, it is noted that the metal baffle 1140 further includes a hook 11400 integrally formed with the metal baffle 1140 to be in contact with the metal housing 12. In another preferred embodiment of the present invention, the hook 11400 may have an arcuate shape 11401. Both the hook-like shape 11400 and the arcuate shape are used to connect to the metal housing 12. However, because the hook-like shape has much better elasticity than the arcuate shape, which makes the hook-like structure has much longer lifespan than the arcuate shape. On the other hand, as the hook-like shape has a unilateral direction when transmitting crosstalk and the arcuate shape has multiple diversified directions when transmitting crosstalk, the hook 11400 has much better crosstalk reducing effect.

In still a preferred embodiment of the present invention, the metal baffle 1140, the metal housing 12 and the metal casing 13 are all make of iron. However, the material for producing the metal baffle 1140, the metal housing 12 and the metal casing 13 may be copper, aluminum, silver or the like with great electricity conductance.

Figure 3:
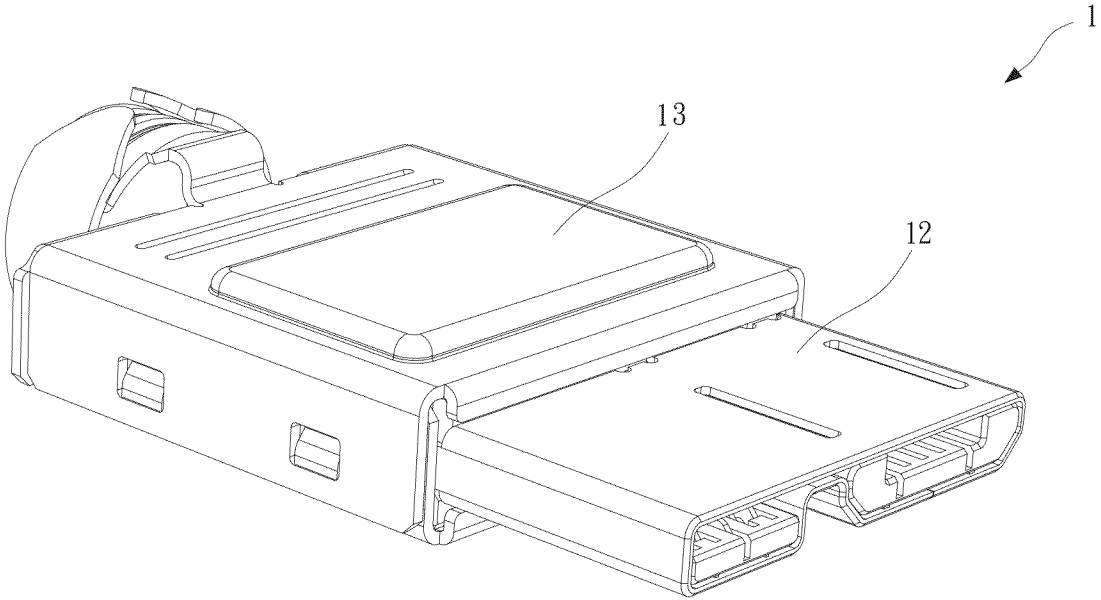
FIG. 3 is a perspective view showing the connector constructed in accordance with the preferred embodiment of the present invention.
Figure 4B:
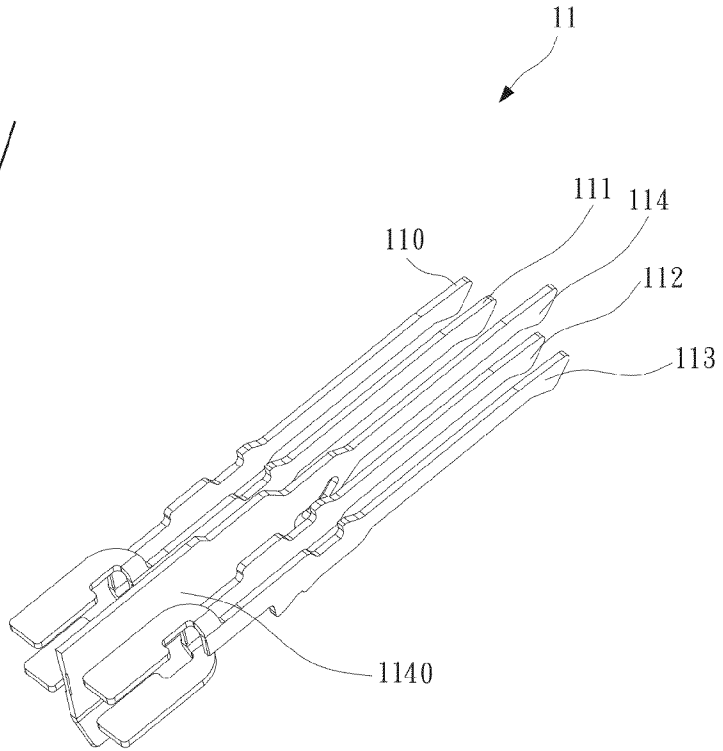
FIG. 4B is an enlarged perspective view showing the structure of the terminals of the present invention.
Figure 4A:
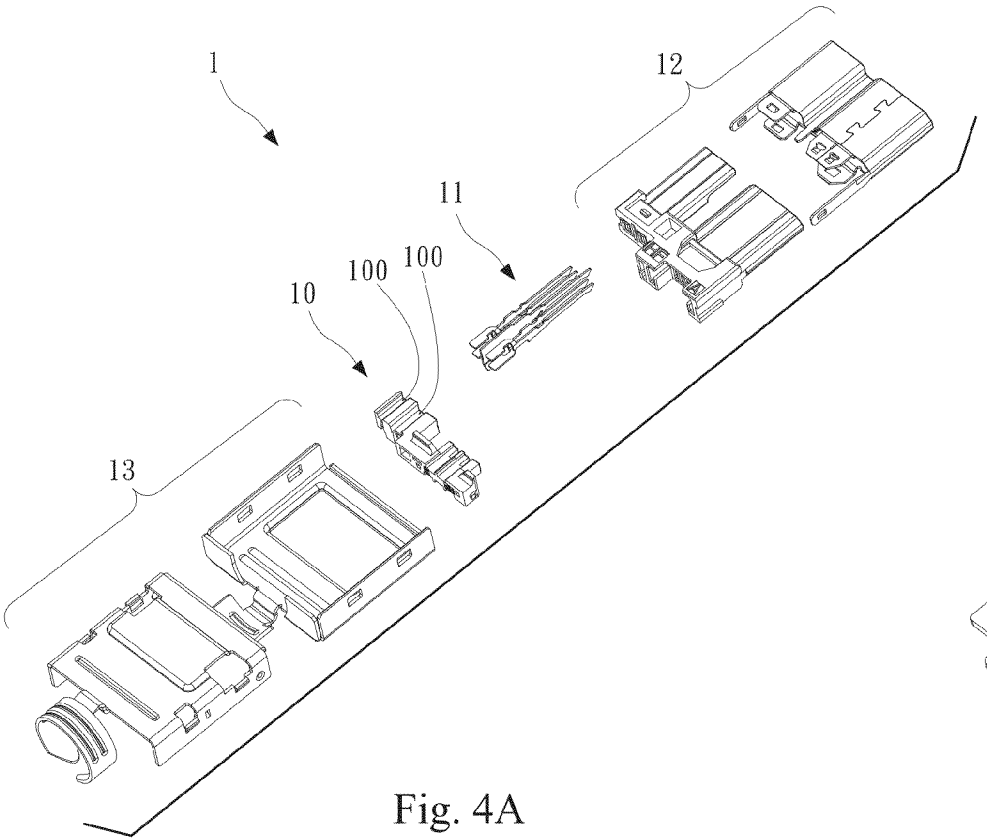
FIG. 4A is an exploded perspective view showing the elements of the connector of the present invention.
Figure 5:
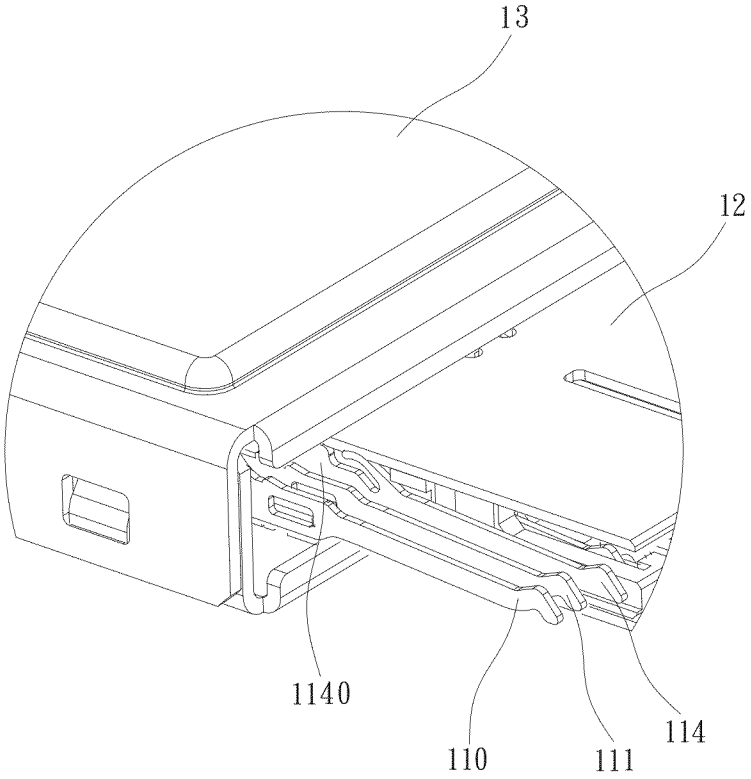
FIG. 5 is a perspective view of a portion of the connector of the present invention.
Figure 6:
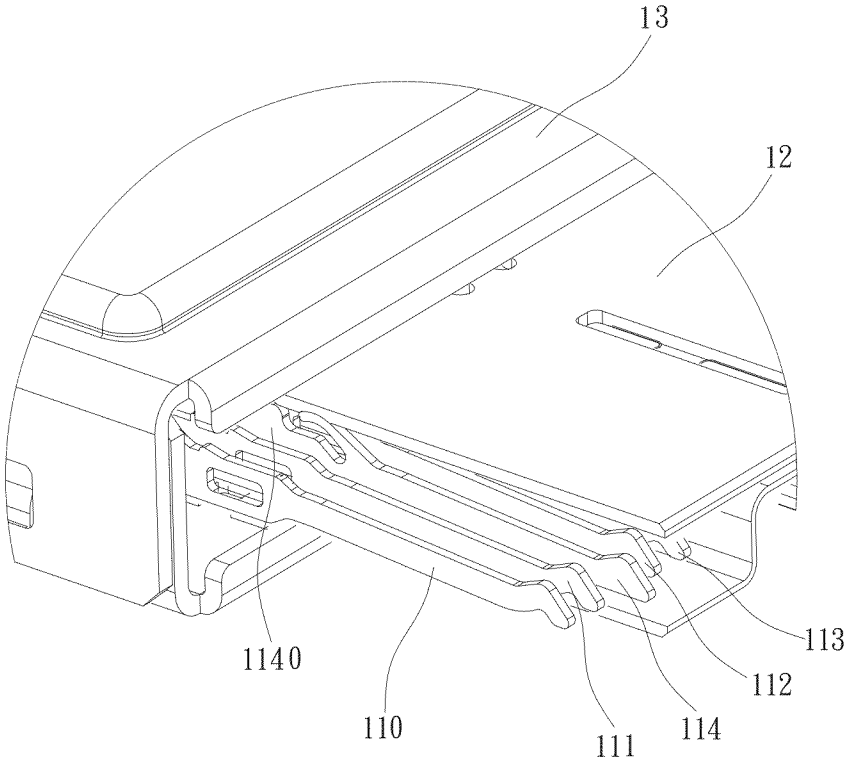
FIG. 6 is still a perspective view of a portion of the connector of the present invention.

With reference to FIGS. 3, 4A and 4B, in addition to the addition of the ground terminal 114 between two mutually affected terminals 11, the connection between the ground terminal 114 and the metal housing 12 and the great electricity conductance of the ground terminal 114, the metal housing 12, and the metal casing 13, the crosstalk generated between two mutually affected terminals 11 is able to be effectively directed by the hook 11400. As a result, the metal baffle 1140 is for grounding and forms a great protection to obviate the generation of crosstalk between the first top signal terminals 110 and the first bottom signal terminals 111 as well as between the second top signal terminals 112 and the second bottom signal terminals 113. When compared with the conventional structure, the structure constructed in accordance with the present invention further reduces 0.2%~0.5% near end crosstalk and maintains the information accuracy especially when being transmitted. Delay of information is thus avoided.

It is to be noted that although the preferred embodiment of the present invention has been described, other modifications, alterations or minor change to the structure should still be within the scope defined in the claims. As those skilled in the art will readily observe that numerous modifications and alterations of the device and method may be made while retaining the teachings of the invention.

What is claimed is:

1. A connector comprising:

a fixture with multiple slits defined therein;

multiple terminals having one ends received in corresponding slits, the terminals having other ends exposed from the fixture, the terminals being composed of a first group of terminals including first top signal terminals, and first bottom signal terminals, a second group of terminals including second top signal terminals, and second bottom signal terminals, and a ground terminal disposed between the first group of terminals and the second group terminals on a straight line that both the first and second groups of terminals are disposed upon, the ground terminal having one end provided with a metallic baffle having one side corresponding to the first top signal terminals and the first bottom signal terminals, and another side corresponding to the second top signal terminals and the second bottom signal terminals;

a metal housing enclosing the exposed other ends of the terminals and connected to the metallic baffle; and a metal casing enclosing the fixture and a part of the metal housing.

2. The connector as claimed in claim 1, wherein the metal baffle further has a hook integrally formed with another part of the metal baffle to connect to the metal housing.

3. The connector as claimed in claim 1, wherein the metal baffle further has an arcuate shape to engage with the metal housing.

4. The connector as claimed in claim 1, wherein the ground terminal is disposed on the straight line between the first bottom signal terminals and the second top signal terminals, further wherein the ground terminal is disposed on the straight line between the second bottom signal terminals and the first top signal terminals.

5. The connector as claimed in claim 1, wherein the metal housing encloses a portion of the ground terminal.

6. The connector as claimed in claim 1, wherein the ground terminal is disposed on the straight line between the first group of terminals and the second group terminals so as to reduce crosstalk generated between the first and second groups of terminals.

* * * * *